United States Patent [19]

Weber et al.

[11] 4,345,529

[45] Aug. 24, 1982

[54] POLLUTION REDUCTION SMOKELESS AUTO INCINERATOR

[76] Inventors: Roy Weber, P.O. Box 336; Bruce C. Huddleston, 865 N. Kalaheo Ave., both of Kailua, Oahu, Hi. 96734

[21] Appl. No.: 65,800

[22] Filed: Aug. 13, 1979

Related U.S. Application Data

[60] Division of Ser. No. 906,814, May 17, 1978, Pat. No. 4,181,081, which is a continuation of Ser. No. 726,529, Sep. 27, 1976, abandoned.

[51] Int. Cl.[3] ..... F23B 5/00; F23C 9/00; F23G 7/06

[52] U.S. Cl. ..... 110/213; 110/211; 110/214; 110/345; 431/5

[58] Field of Search ..... 110/236, 213, 212, 211, 110/210, 345, 215, 214; 431/5

[56] References Cited

U.S. PATENT DOCUMENTS

| | | | |
|---|---|---|---|
| 3,164,445 | 1/1965 | Hampel | 110/212 X |
| 3,190,823 | 6/1965 | Bloxham | 110/213 X |
| 3,215,501 | 11/1965 | Phillips | 110/213 X |
| 3,342,241 | 9/1967 | Whitesides | 431/5 X |
| 3,408,167 | 10/1968 | Burden | 110/213 X |
| 3,412,985 | 11/1968 | Perry et al. | 110/215 X |
| 3,548,760 | 12/1970 | Yarnell et al. | 110/213 |
| 3,566,809 | 3/1971 | Carry et al. | 110/212 X |
| 3,567,399 | 3/1971 | Altmann et al. | 110/213 X |
| 3,613,562 | 10/1971 | Brewer | 110/236 X |
| 3,631,823 | 1/1972 | Scogin | 110/213 |
| 3,741,133 | 6/1973 | Kleinfelter | 110/236 X |
| 3,881,870 | 5/1975 | Hatfield | 110/212 X |
| 4,023,508 | 5/1977 | Cantrell, Jr. et al. | 110/212 |
| 4,052,266 | 10/1977 | Griffith | 431/5 X |
| 4,145,979 | 3/1979 | Lilley | 110/214 X |
| 4,181,081 | 1/1980 | Weber | 110/212 |

*Primary Examiner*—Edward G. Favors
*Attorney, Agent, or Firm*—James C. Wray

[57] ABSTRACT

A smoke control device for use in motor vehicle incineration. Smoke from burning vehicles in an incineration area is directed into a collecting chamber by controlled air flows and flaps. Updrafts evacuate the chamber and force the smoke into a combustion stack. The column of smoke in the stack is raised to combustion temperature by heaters mounted on the stack. The superheated smoke is combined with heated air in the vicinity of an open flame causing combustion resulting in a clear stack discharge.

17 Claims, 22 Drawing Figures

FIG. 3
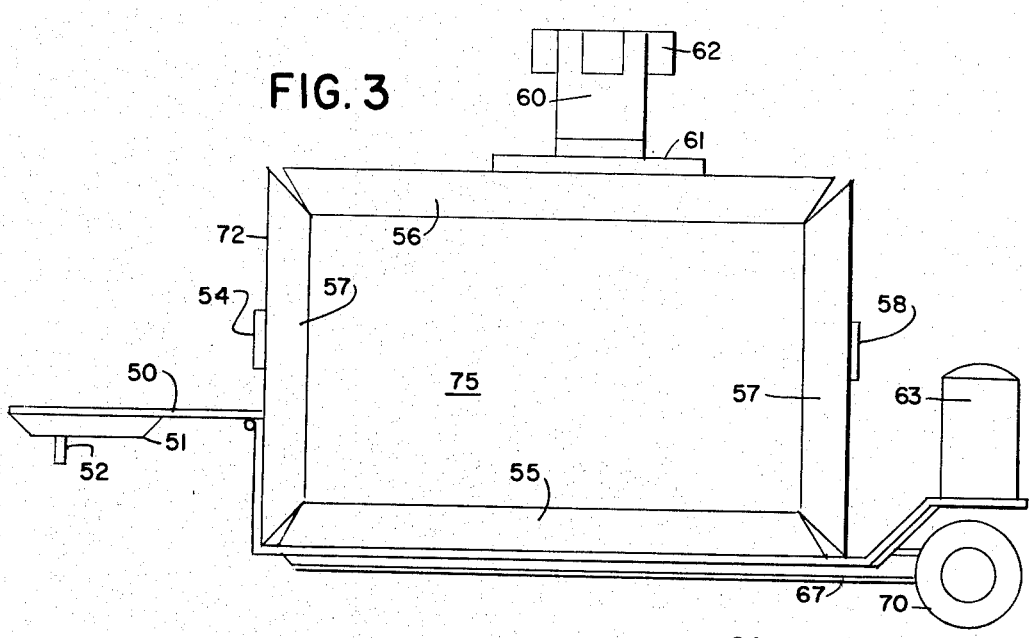
FIG. 4
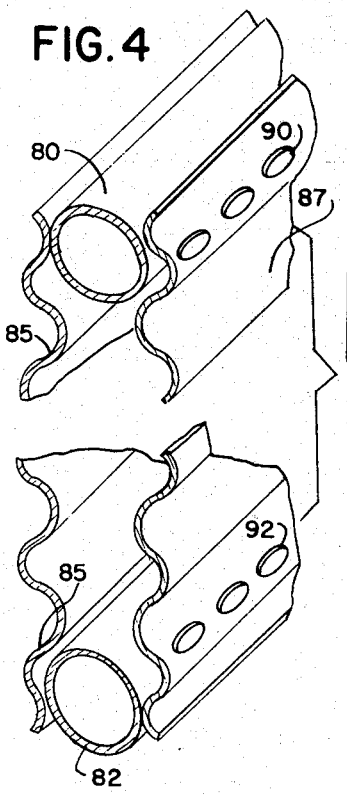
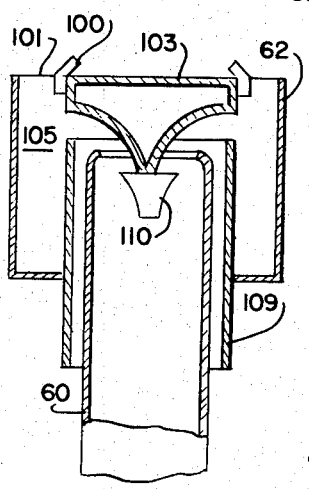
FIG. 5
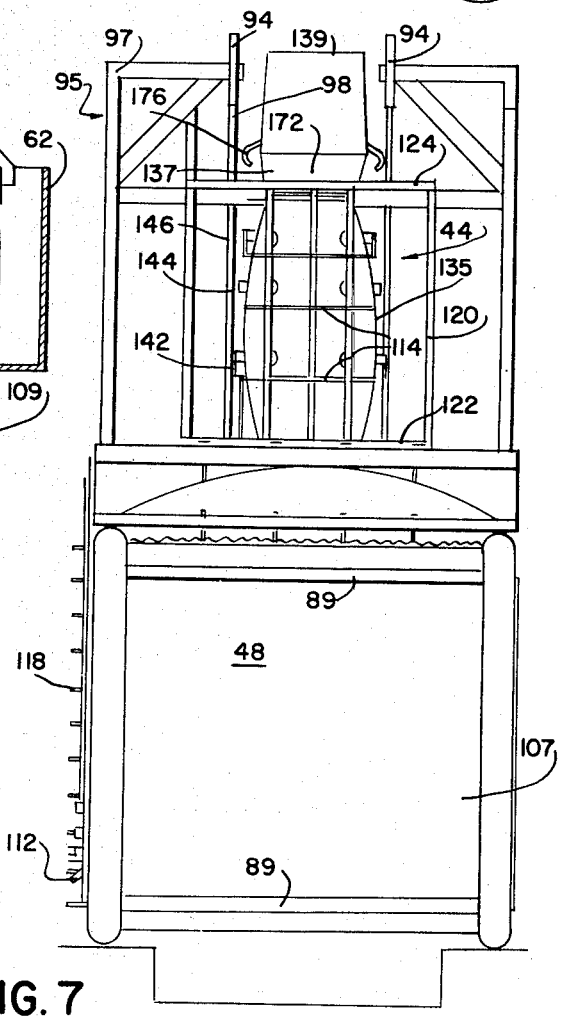
FIG. 7

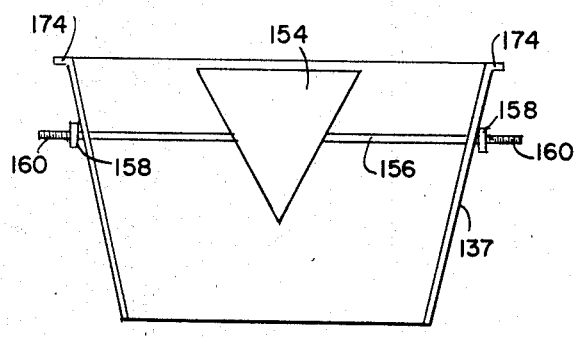
FIG. 11
FIG. 12A
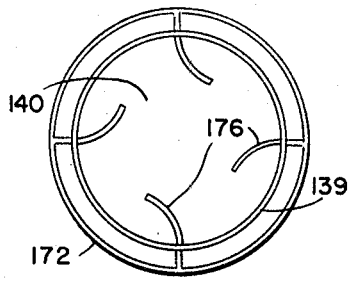
FIG. 12B
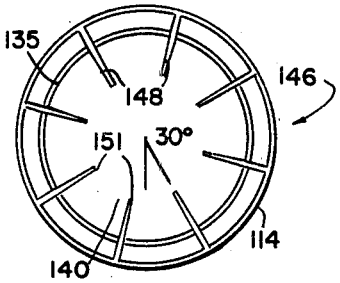
FIG. 13
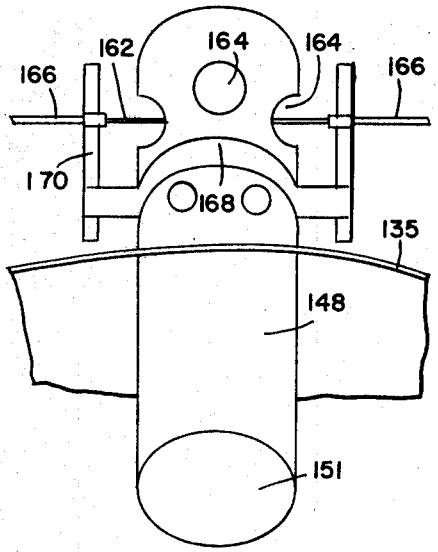
FIG. 12C
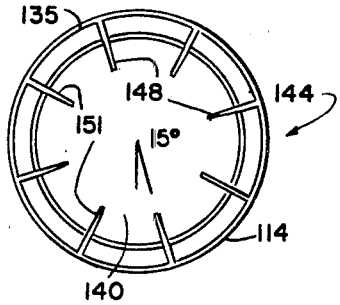
FIG. 12D
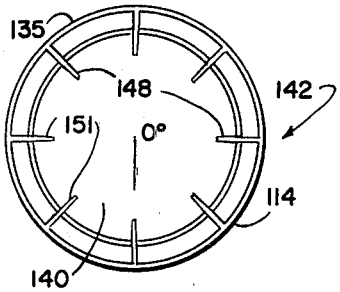

POLLUTION REDUCTION SMOKELESS AUTO INCINERATOR

This is a division of application Ser. No. 906,814, filed May 17, 1978, now U.S. Pat. No. 4,181,081, which is a continuation of application Ser. No. 726,529, filed Sept. 27, 1976, now abandoned.

BACKGROUND OF THE INVENTION

This invention relates generally to incinerators and more particularly has reference to a smokeless incinerator used to convert old cars into charred scrap metal hulls.

A number of methods are available to prepare old cars for resale as scrap metal. The easiest and most popular method is incineration. However, most cars contain a variety of combustible materials such as plastic, foam, rubber, undercoating and grease. Due to the expense and time involved in removing such materials prior to incineration, the cars are commonly left intact. This results in visible, irritating pollution and smoke as these materials burn off the car during incineration. Such discharges often do not meet local environmental standards. The demand for a nonpolluting and smokeless vehicle incinerator capable of burning cars intact is apparent.

DESCRIPTION OF THE PRIOR ART

A number of smoke control incinerators have been previously disclosed. The most effective operate on the principle that smoke is the result of incomplete primary combustion and therefore can be eliminated through secondary combustion.

The smoke is heated and combined with oxygen to produce the secondary combustion.

Others are unusual smoke stack designs such as inner and outer stack configurations or tortuous paths through the stack to eliminate smoke. Still others cleanse the smoke with water or chemical sprays.

A number of smoke control devices attach to existing incinerator unit.

Mobile units have been used to incinerate continuous rows of material.

Many problems remain in these prior art devices. Those designed to burn trash, garbage or other loose refuse cannot effectively accommodate large quantities of bulky items such as automobiles. Others, specifically designed to accommodate autos, are very complex relying primarily on the water and chemical spray or gas drying techniques. Lack of substantial air flow induction through these devices hinders complete incineration of the autos and thorough clearing of combustion discharge.

SUMMARY OF THE INVENTION

The present invention overcomes many of the problems which exist in the prior art devices. It provides an inexpensive and simplyconstructed device capable of thoroughly incinerating large quantities of motor vehicles without discharging appreciable smoke pollution.

In one embodiment, cars to be incinerated are stacked in a confining area between a mobile smoke guiding unit and a mobile smoke control unit. Air flow generated by the guiding unit causes flames generated by flame guns mounted on the guiding unit to envelop the cars. As the cars begin to burn, controllable directed air streams generated by the guiding unit cooperate with directing flaps to guide smoke into the smoke control unit.

Preferably, the control unit has a smoke elimination stack connected atop a smoke collecting chamber. Smoke is initially received by the collecting chamber and forced into the stack by stack updrafts and natural air intake. In the stack, the smoke is superheated and then combined with heated oxygen injected into the stack adjacent an open flame. The resulting combustion produces extreme temperatures and intense flame which clear the stack discharge of smoke.

In another embodiment, cars are transported into an incinerating chamber having a single opening. A smoke control unit connected to the chamber receives all emission from the opening and cleanses it before discharge to the environment.

Preferably, the control unit has a smoke collecting chamber and smoke elimination stack.

Objects of the invention are, therefore, to provide an improved incinerator, to provide an incinerator which is highly efficient in incinerating autos to prepare them for resale as scrap metal, to provide an incinerator which is smokeless in operation, to provide an incinerator having a smoke elimination stack which is effective to burn and eliminate all smoke produced in the primary incineration of the autos. To further provide an incinerator adapted for mobility adjacent stacked autos enabling large numbers of autos to be quickly incinerated, to provide an incinerator which induces substantial flow of air through the incinerator facilitating complete burning of combustible materials on the autos and thorough clearing of incinerator discharge, and to provide an incinerator of the type described which is of relatively simple and inexpensive construction and operation.

Another object of the invention is the provision of a smokeless motor vehicle incinerator having vehicle confining means for receiving and holding motor vehicles to be incinerated, igniting means adjacent the vehicle confining means for inflaming vehicles held by the vehicle confining means, smoke guiding means adjacent the vehicle confining means for directing smoke generated by incineration of vehicles held by the vehicle confining means to smoke control means, smoke control means adjacent the vehicle confining means for receiving smoke generated by incineration of vehicles held by the vehicle confining means, converting substantially all of the received smoke to heat, and expelling heat into the environment, the smoke control means comprising a smoke collecting chamber adjacent the vehicle confining means for receiving smoke from the vehicle confining means and communicating received smoke to smoke elimination means, smoke elimination means connected to the smoke collecting chamber for receiving smoke from the smoke collecting chamber comprising smoke heating means for heating received smoke, smoke combustion means for converting received smoke into heat through combustion, and expelling means for releasing the heat into the environment.

Still another object is to provide a smokeless motor vehicle incinerator wherein the vehicle confining means comprises a longitudinal wall formed about a horizontal axis having open proximal and closed distal ends and an interior space sufficiently large to hold motor vehicles, vehicle moving means adjacent the proximal end for transporting vehicles through the proximal end, door mounting means connected to the wall adjacent the proximal end configured to mount a door for selective covering and uncovering of the proximal end, a door connected to the door mounting means, and an opening in the upper end of the wall adjacent the interior space for communcating smoke from the interior space to the smoke control means, the smoke control means connected to the longitudinal wall in vertical alignment with the opening.

A further object is to provide a smokeless motor vehicle incinerator having a first moving means connected to the smoke control means and the ground to enable lateral movement of the smoke control means, a second moving means connected to the ignition means, smoke guiding means and the ground to enable lateral movement of the ignition means and smoke guiding means, the first and second moving means longitudinally spaced and parallel, enclosing means connected to the smoke control means, the ignition means and the smoke guiding means for enclosing the longitudinal space between the first and second moving means, the vehicle confining means comprising the longitudinal space and the enclosing means.

Yet another object is to provide a smokeless motor vehicle incinerator wherein the smoke elimination means comprises a side wall means formed about a vertical axis bounding an open interior column having a lower open smoke receiving end connected to the smoke collecting chamber and an upper open heat expelling end, smoke heating means comprising a source of pressurized flame gun operating fuel, flame guns mounted radially on the side wall means having inward open ends projecting into the open interior column for injecting smoke heated ignited fuel into the column and having outward ends configured for connection to fuel supply lines, fuel supply lines connected to the outward ends of the flame guns and the source of fuel for communicating fuel from the source to the flame guns, flame gun igniting means connected to the flame guns for igniting the initial fuel injected into the column, smoke combustion means comprising a choke support means connected to the side wall means for movably supporting a choke means in the open upper end of the column, choke means connected to the choke support means for diffusing smoke heating flame from the flame guns to circular shape adjacent the inner surface of the side wall, means opposite the choke means and for providing a limited restriction in the column to facilitate sufficient smoke heating, a source of pressurized air, air heating means comprising air tubes coiled around the outer surface of the side wall means adjacent the circularly deflected flame for heating combustion aiding air in the tubes, air supply lines connected to the source of compressed air and the air heating means for communicating air from the source to the air heating means, air injection means connected to the air heating means and the side wall means adjacent the upper end for communicating heated air from the air heating means to the interior column and combining the heated air with the heated smoke and the flame from the flame gun in the column thereby forming an intense flame in the column adjacent the upper end which ignites the smoke in the column and converts that smoke to heat, expelling means for expelling heat from the interior column into the environment comprising a side wall extension means connected to the upper end of the side wall means forming a flame vortex space adjacent the upper open end of the interior column providing contact between the intense smoke igniting flame and the environment to maintain the ideal combustion environment for combustibles in the smoke and to expel heat from the smoke igniting flame into the environment.

A still further object is to provide a smokeless motor vehicle incinerator wherein flame guns are mounted on the side wall in spaced vertically adjacent annular rows, the rows comprising flame guns mounted at equally spaced intervals around the circumference of the side wall angled upward toward the interior, the flame guns of each row rotatively offset from the flame guns of the adjacent rows an angular distance proportional to the angular intervals between flame guns in the rows and the numerical total of the rows.

Another object is to provide a smokeless motor vehicle incinerator wherein the air tubes are thin, flexible tubes coiled around the outer surface of the side wall, the air injection means are thin, flexible tubes radially mounted at equally spaced intervals around the circumference of the side wall having inward open ends projecting into the open interior column for injecting heated air into the column and having outward ends connected to the air tubes, the inward ends curved surstantially parallel to the inner surface of the side wall inducing a swirling flow of air in the column to combine the heated air, the heated smoke, and the flange from the flame guns.

Still another object of the invention is to provide a smokeless motor vehicle incinerator wherein the side wall means comprises a first side wall formed in substantially cylindrical shape about a vertical axis having upper and lower open tapered ends, a second side wall formed in a conical shape having a relatively large lower open end and a relatively small upper open end, the lower end vertically aligned with and connected to the upper open end of the first side wall, the upper end connected to the expelling means, a first annular flange connected to the outer surface of the first side wall, a second annular flange connected to the outer surface of the second side wall, a stack connecting annular flange connected to the lower end of the first side wall, a side wall sleeve formed in substantially cylindrical shape about a vertical axis having lower and tapered upper open ends configured to receive the first and second side walls, a sleeve connecting annular flange connected to the lower end of the side wall sleeve, the sleeve connecting and stack connecting flanges vertically aligned and connected, the inner surface of the side wall sleeve contacting the first annular flange thereby supporting the sleeve upright and vertically aligning the sleeve with the first and second side walls.

Yet another object is the provision of a smokeless motor vehicle incinerator wherein the smoke collecting chamber comprises a first chamber having upper and lower open ends, a second chamber having upper and lower open ends, the upper end of the second chamber connected to the lower end of the first chamber, the upper end of the first chamber connected to the smoke elimination means, the lower end of the second chamber connected to the vehicle confining means, fan supporting means connected to the second chamber for supporting a fan within the chamber, fan means connected to the fan supporting means for controlling draft in the smoke collecting chamber and the smoke elimination means, throttle supporting means connected to the first chamber for supporting a throttle means within the first chamber, throttle means connected to the throttle supporting means for further controlling draft in the smoke collecting chamber and the smoke elimination means.

A further object is to provide a smokeless motor vehicle incinerator apparatus wherein the smoke collecting chamber comprises a first chamber having upper and lower open ends, a second chamber having upper and lower ends and an open side wall facing the vehicle confining means for receiving smoke from the vehicle confining means, an opening in the upper end of the second chamber, the lower end of the first chamber connected to the upper end of the second chamber around the opening, the upper end of the first chamber connected to the smoke elimination means, the lower end of the second chamber connected to the first moving means, flap supporting means connected to the second chamber for supporting flaps around the open side wall, flaps movably connected to the flap supporting means for controlling the flow of smoke through the open side wall into the second chamber, air intake means connected to the second chamber providing flow of air into the second chamber.

Yet a further object is to provide a smokeless motor vehicle incinerator apparatus wherein the enclosing means comprises a horizontal roof connected to the upper ends of the smoke control means and the smoke guiding means, side wall supporting means connected to the roof for suspending side walls from opposite lateral edges of the roof, and side walls connected to the side wall supporting means capable of selective covering and uncovering of the lateral sides of the enclosing means.

Another object is to provide a smokeless motor vehicle incinerator wherein the smoke guiding means comprises a body connected to the second moving means having an open side wall facing the vehicle confining means, air blower means mounted in the open side wall air injector means mounted in the open side wall either side of the air blower means, the ignition means mounted peripherally around the open side wall, flap supporting means for supporting movable flap around the open side wall, and flaps movably connected to the flap supporting means for controlling the flow of air from the smoke guiding means to the vehicle confining means.

These and other and further objects and features of the invention are apparent in the disclosure which includes the above and below specification and claims and drawings.

BRIEF DESCRIPTION OF THE DRAWINGS

FIG. 3 is a front elevation of the smoke control unit of a second motor vehicle incinerator embodying the principles of the present invention.

FIG. 4 is a horizontal sectional view of upper and lower side wall fragments of the smoke control units shown in FIGS. 1–3.

FIG. 5 is a sectional elevation of the ash collector.

FIG. 7 is a rear elevation of the incinerator shown in FIG. 6.

FIG. 11 is a sectional detail of the choke shown in FIGS. 8 and 9.

FIGS. 12A, 12B, 12C and 12D are plan detail views, partly in section, of the air injector and third, second and first heating levels respectively shown in FIGS. 8 and 9.

FIG. 13 is a perspective detail of the igniter for the flame guns shown in FIGS. 7, 9, 10 and 12.

DETAILED DESCRIPTION OF THE DRAWINGS

Figure 1:
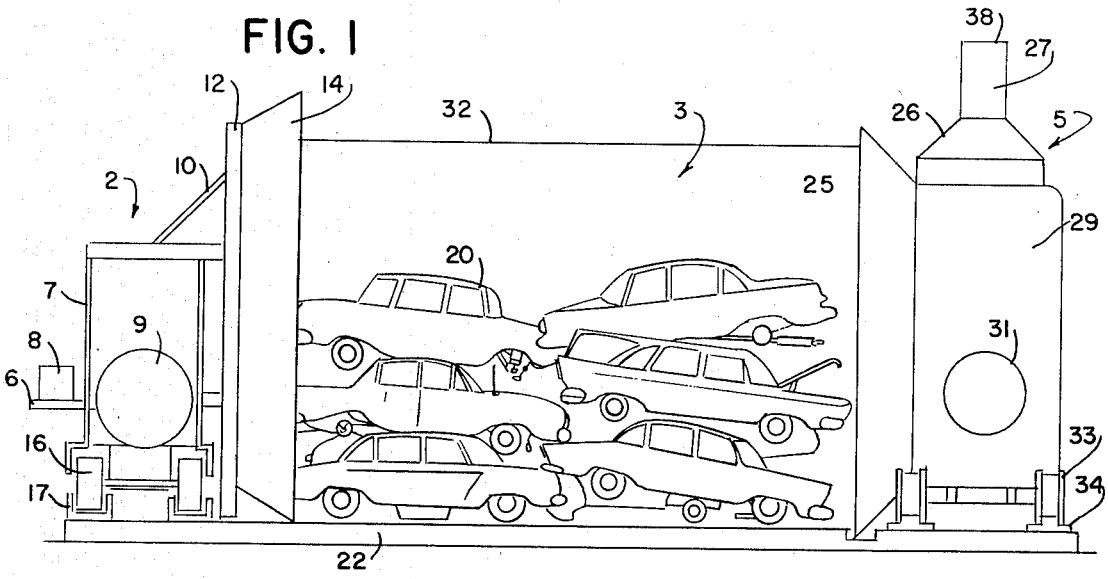
FIG. 1 is a side elevation of a motor vehicle incinerator embodying the principles of the present invention.
Figure 2:
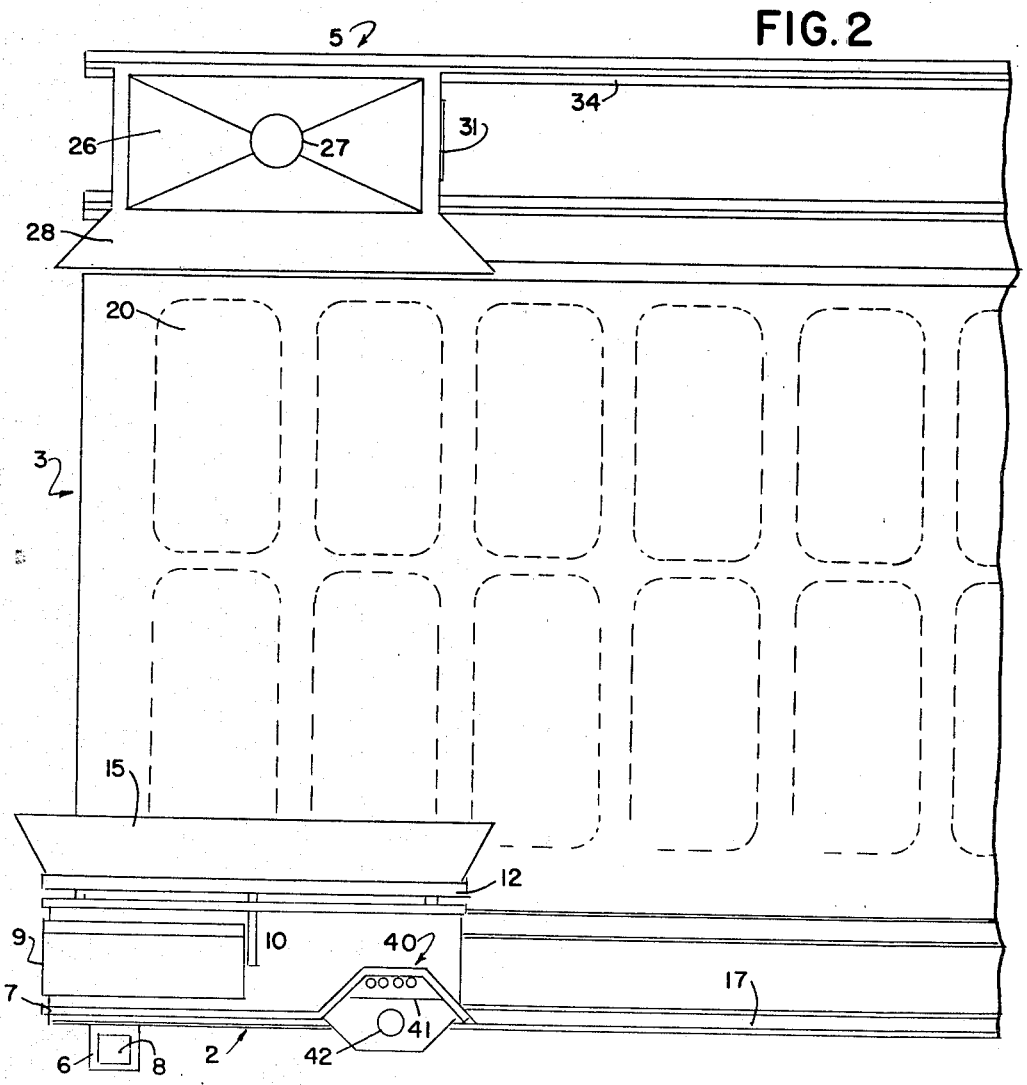
FIG. 2 is a plan view of the incinerator shown in FIG. 1.

The incinerator shown in FIG. 1 has an air unit 2, a vehicle confining area 3 and a smoke control unit 5. A plurality of stacks of cars 20 to be incinerated are placed in the confining area 3 which is bounded on opposite lateral sides by parallel sets of tracks 17 and 34. Track wheel assemblies 16 and 33 are connected to the air unit 2 and smoke control unit 5 to enable movement of the units parallel to the stacks of cars 20. By maintaining lateral alignment between the air unit 2 and the smoke control unit 5 as both are moved along the tracks 34 and 17, a large volume of cars 20 stacked between the tracks 17 and 34 can be incinerated in a short period of time. A base 22 of suitable non-combustible material underlies the entire assembly.

The air unit 2 is used to ignite the cars 20 and direct smoke from the burning cars 20 into the smoke control unit 5. For maximum mobility, air supply tanks 9 and an operations control room 40 are mounted on the air unit 2. From a single control chair 42 and control panel 41, an operator can monitor and regulate the performance of the entire incinerator. The front wall 12 and wall support strut 10 of the air unit 2 support means to ignite the cars and control the smoke. The rear wall 7 supports fuel tanks 8 on a platform 6 a safe distance away from the heat of the vehicle confining area 3.

Figure 14:
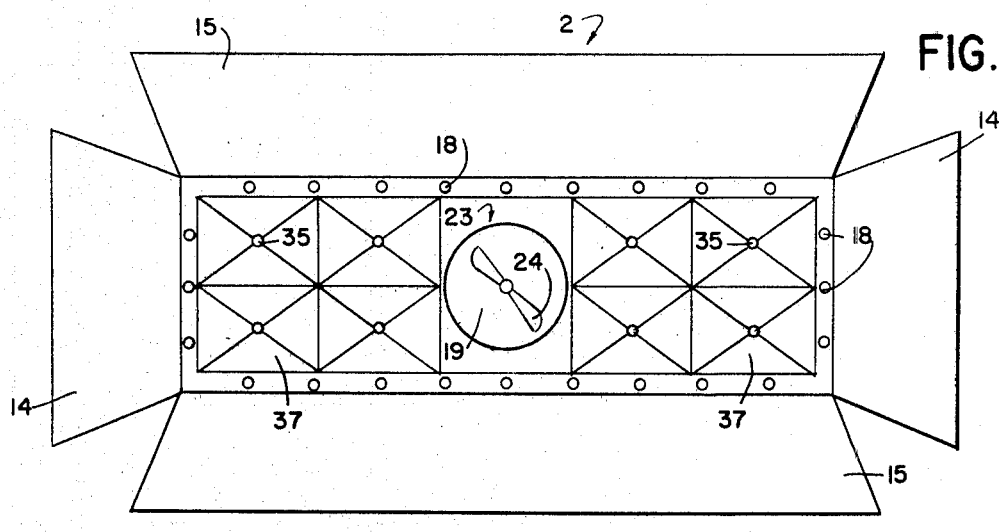
FIG. 14 is a front elevation of the air units shown in FIGS. 1 and 2.
Figure 15A:
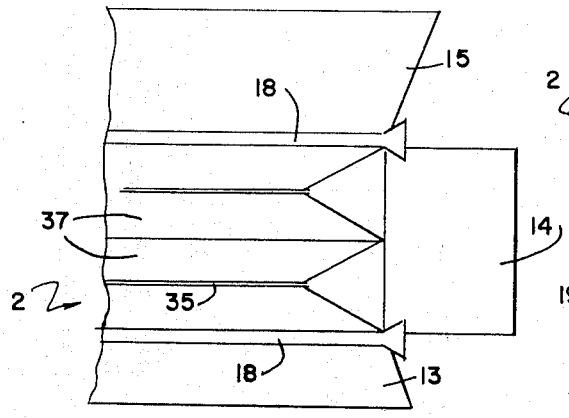
FIG. 15A is a sectional view taken along the line A—A in FIG. 14.
Figure 15B:
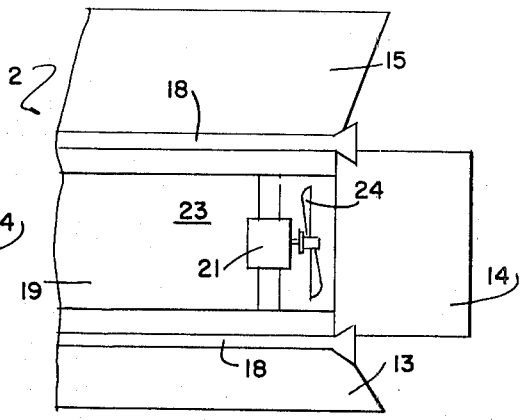
FIG. 15B is a sectional view taken along the line B—B in FIG. 14.
Figure 17:
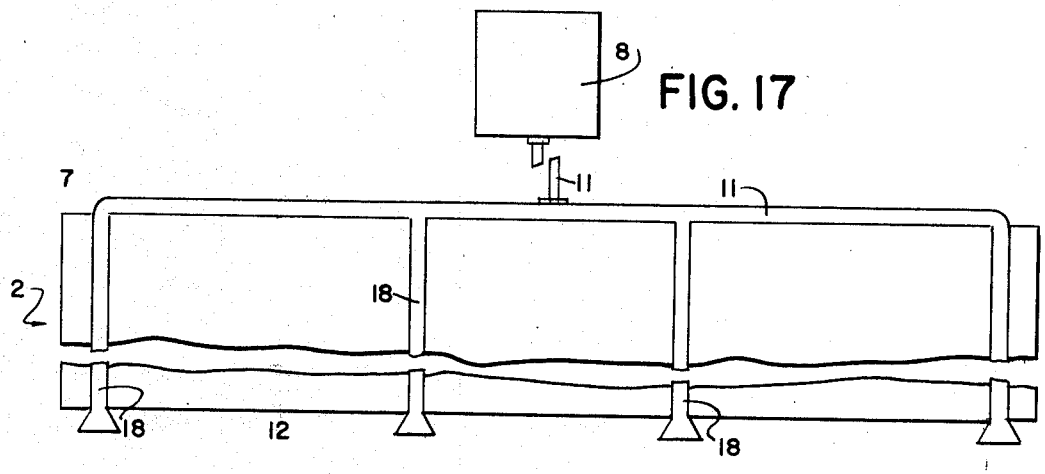
FIG. 17 is a plan detail of the flame gun system shown in FIG. 14.

A plurality of flame guns 18 (see FIGS. 14, 15 and 17) mounted on the periphery of the air unit 2 project from the front wall 12 for injecting car igniting flame into the confining area 3. The guns 18 are fed from the fuel supply tanks 8 by fuel supply lines 11. Ignition means similar to those in FIG. 13 are mounted on each gun 18. The operation of the ignition means are described later. To insure complete incineration of all cars 20 in the confining area 3, the flame guns are connected to moving means (not shown) which selectively adjust the location of the guns 18.

Figure 16:
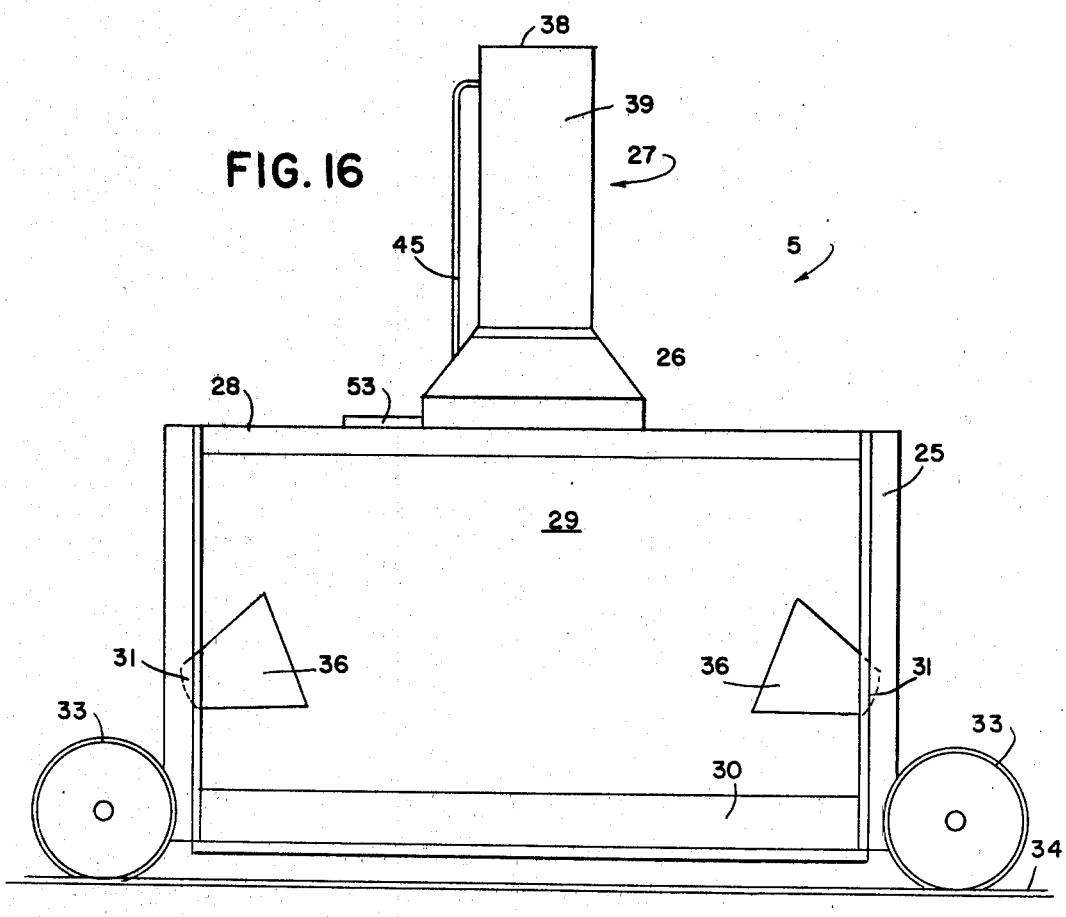
FIG. 16 is a front elevation of the smoke control unit shown in FIGS. 1 and 2.

A fan assembly 23 mounted in a central cavity 19 in the front wall 12 of the air unit 2 creates sufficient draft in the confining area 3 to insure the maximum amount of flame reaches the greatest number of cars 20. After the cars 20 are ignited, the flame guns 18 are turned off and the speed of the flame blade 24 reduced. Air injectors 35 mounted in air ducts 37 on the front wall 12 of the air unit 2 inject controllable streams of directed air into the confining area 3 to guide smoke from burning cars 20 to the smoke control unit 5. Adjustable side flaps 14, an upper flap 15 and a lower flap 13 control the flow of air injected into the confining area 3 achieving most effective control of smoke direction. In an alternative embodiment, steam injectors replace the air injectors 35. Corresponding adjustable side flaps 25, upper flap 28 and lower flap 30 guide the air directed smoke into the open front wall of a burn chamber 29 in the smoke control unit 5. Air intake openings 31 in the sides of the chamber 29 allow for natural air intake and are fitted with air ducts 36 (see FIG. 16) and pressurized air intake valves (not shown) fed by a compressor (not shown) to insure adequate oxygen supply for combustion. In an alternative embodiment, the flaps 25, 28 and 30 are closed completely covering the open front wall of the chamber 29 enabling use of the smoke control unit 5 as a complete smokeless incineration unit independent of the air unit 2 and vehicle confining area 3.

Air in the smoke elimination stack 27 is heated prior to entry of smoke into the burn chamber 29 creating an updraft in the stack 27. Smoke guided into the burn chamber 29 is forced through the smoke collector chamber 26 into the stack 27 by the updraft. Means to convert the smoke to heat are mounted in the stack 27 with the resultant heat expelled from an open top 38 of the stack 27 into the environment. Openings 43 in a stack sleeve 39 provide a flow of stack cooling air between the stack 27 and sleeve 33. A catwalk 53 and ladder 45 provide ready access to the stack 27.

Figure 18:
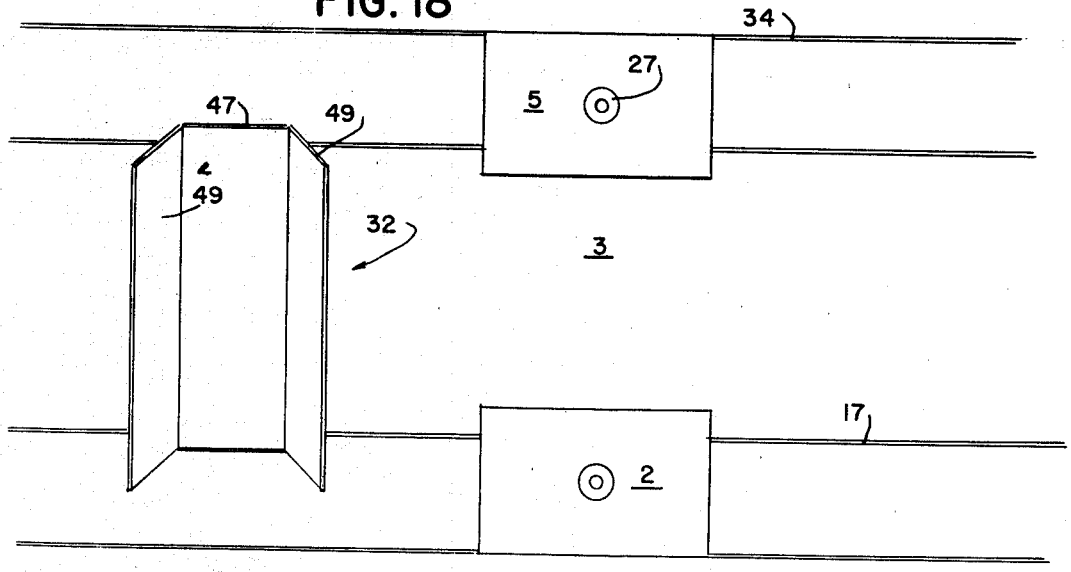
FIG. 18 is a plan view of the incinerator shown in FIG. 2 with the cover included.

A cover 32 (see FIG. 18) for the confining area 3 has a roof 47 and side walls 49 suspended from opposite lateral edges of the roof 47. The walls 49 are hinged to enable selective covering and uncovering of the lateral sides of the confining area 3. In one embodiment, the roof is connected to and supported by the roofs of the air unit 2 and the smoke control unit 5. In an alternative embodiment, the roof has track wheel supporting means (not shown) connected to track wheels (not shown) which are movable along the tracks 34 and 17.

In a more mobile embodiment, a smoke control unit 75 is mounted on a trailer 67 having ground engaging wheels 70 and hitch means 50, 51 and 52 for attachment to a towing vehicle (not shown). An air tank and compressor 63 are mounted on the trailer 67 for maximum mobility. The burn chamber 72 is provided with smoke guiding flaps 55, 56 and 57 around the open front end and air vents 54 and 58 on opposite side walls.

A smoke collector chamber 61 is connected to the roof of the burn chamber 72 and supports a smoke elimination stack 60. An ash collector 62 adjacent the heat exit opening in the top of the stack 60 removes waste particles from the heated air expelled by the stack 60. The ash collector 62, shown in detail in FIG. 5, works on the principles of high speed centrifugal separators to push the waste particles into ash retaining areas 105 while letting heated air escape through roof 103 openings 101. Steam heads 100 permit selective steam cleaning of the released air. Support sleeve 109 and air column diffuser 110 complete the ash collector assembly 62.

For sake and efficient heat insulation, the walls of the burn chamber comprise an inner panel 85 of flame resistant material such as asbestos, and an outer panel 87 of suitable high temperature material such as steel having lower air intake vents 92 and upper air exhaust vents 90, enabling air flow between the panels 85 and 87 to dissipate heat and reduce the outer panel 87 temperature. Support frame pipes 80 and 82 at the upper and lower ends of the panels 85 and 87 maintain the air flow space between the panels 85 and 87. The pipes 80 and 82 are also incorporated into a steam system, carrying water heated, in part, by the interpanel air flow.

Figure 6:
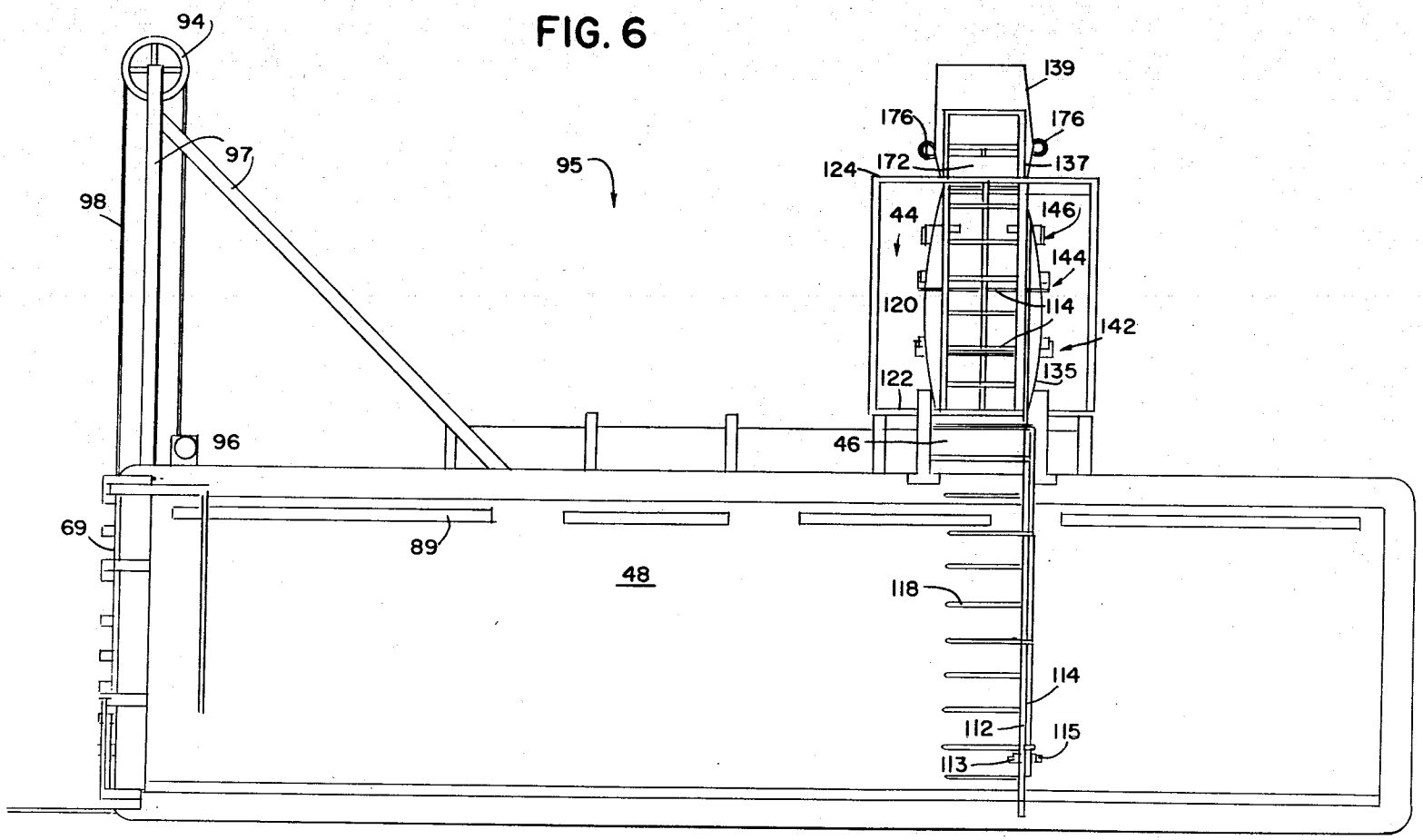
FIG. 6 is a side elevation of a third motor vehicle incinerator embodying the principles of the present invention.
Figure 8:
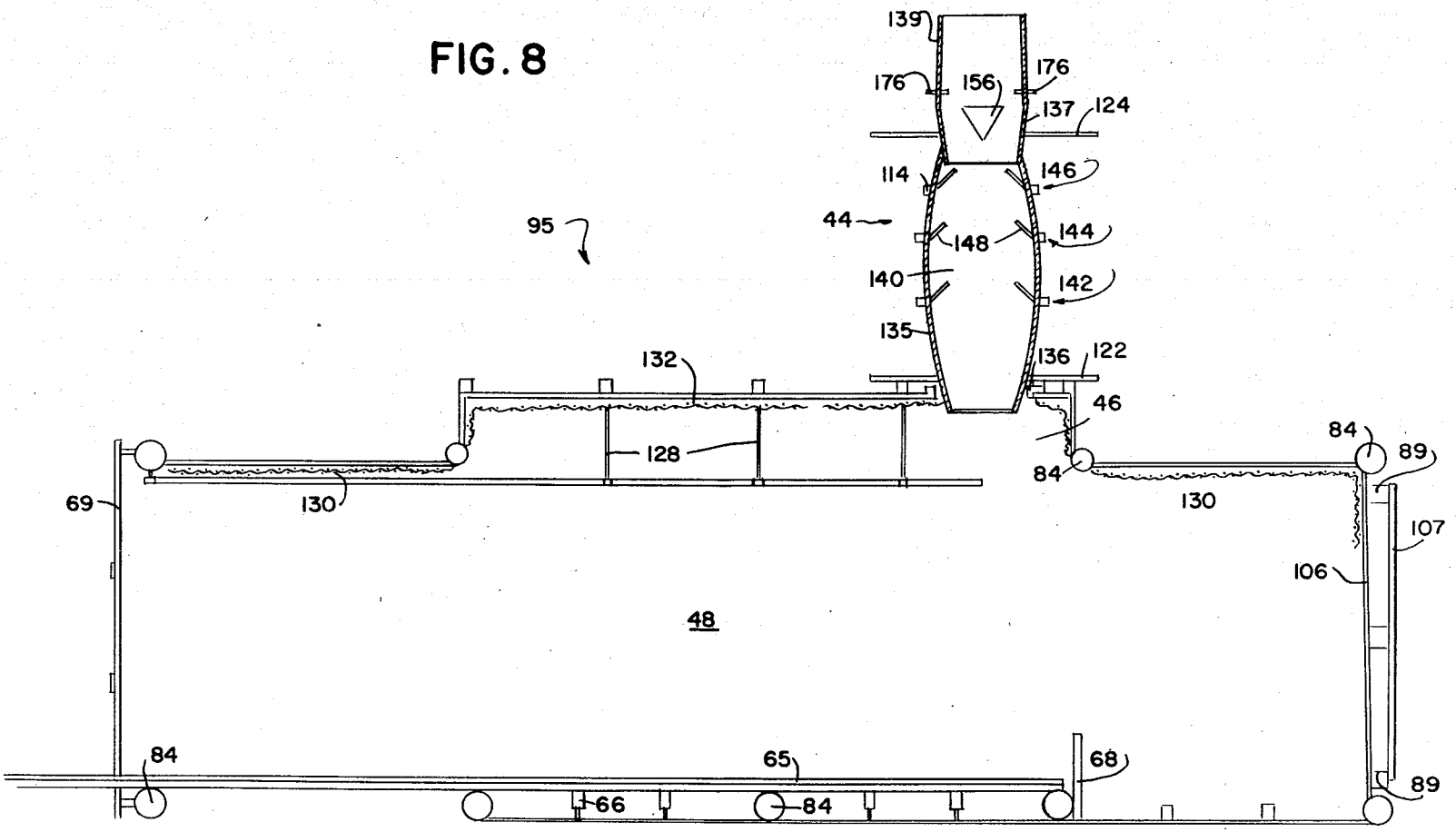
FIG. 8 is a longitudinal section of the incinerator shown in FIG. 6.

In a stationary embodiment of the invention (FIGS. 6, 7 and 8), the smoke elimination stack 44, smoke collector chamber 46, and combined burn chamber and vehicle confining incineration area 48 comprise a single unit 95. Cars to be incinerated are transported into and out of the incineration area by a rail car (not shown) which moves along tracks 65 projecting into the open front end of the unit 95 on box supports 66. Rail car stops insure proper positioning of the cars for incineration. A door 69 is suspended by cables 98 from pulleys mounted atop a supporting framework 97 adjacent the open front end of the unit 95. A motor 96 reels the cable 98 enabling the door 69 to slide vertically for selective covering and uncovering of the opening. Unlike the mobile embodiments, an air unit is not required. With the opening covered, a stack 44 updraft is sufficient to guide smoke from burning cars in the incinerating area 48 to the stack 44.

The incineration area 48 is bounded by a skin having inner panel 106 and outer panel 107. Openings 89 in the outer panel 107 permit a flow of cooling air to circulate between the inner panel 106 and outer panel 107 and are incorporated into a steam system carrying water, heated in part, by the interpanel air flow.

The inner surface of the inner panel 106 is lined with coolant flow lines 132 and insulation 130. Upon completion of incineration, the flow lines 132 are drained through a fire control pipe 126 suspended by hangers 128 from the roof of the incineration area 48.

Figure 9:
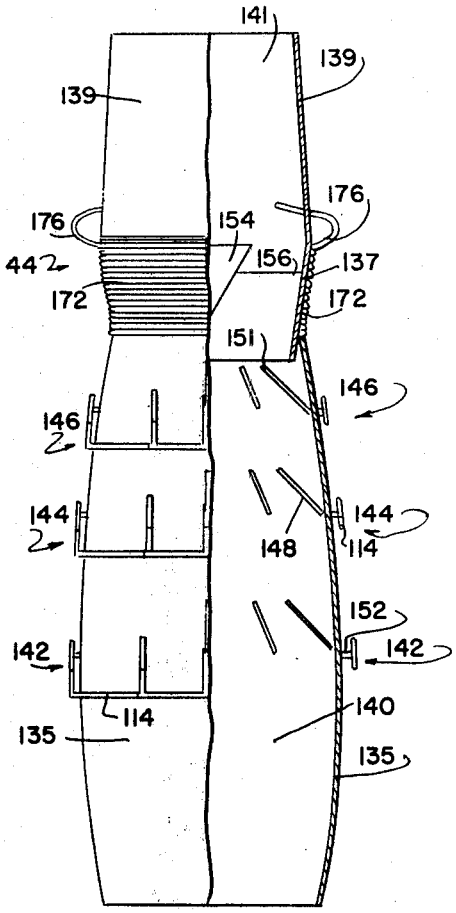
FIG. 9 is an elevational view, partly in section, of the smoke elimination stack shown in FIG. 6.

Upper 124 and lower 122 level catwalks are mounted adjacent the smoke elimination stack 44 by a support 120. A ladder 118 provides access to the catwalks 122 and 124. The smoke elimination stack 44 is press-fitted into a stack location collar 136 connected about an opening in the roof of the incineration area 48 to enable formation of a smoke column 140. As smoke from the incinerating area 48 rises through the column 140, it is progressively heated to combustion temperature by three spaced vertically adjacent heating levels 142, 144 and 146. Each level has a plurality of fuel injectors 148 mounted radially at equally spaced intervals around the circumference of the stack wall 135 having inward open ends 151 projecting into the smoke column 140 for heating the column with ignited fuel and having outward ends 152 connected to fuel supply lines 114 fed from adjustable 115 sources of pressurized fuel (not shown). In one embodiment, the injectors 148 are angled upward 45° intervals around the wall 135 circumference. (see FIG. 9 and FIG. 12)

Each level 142, 144 and 146 is rotatably offset 15° from the adjacent levels. The combination of offset, spacing and angling of the fuel injectors affords completeness and efficiency in column 140 heating. A high resistance wire 162 is supported through openings 164 in the fuel injectors 148 by a supporting strap 168 and terminal mount 170. Current is supplied from an electrical source (not shown) by conducting leads 166 heats the wire 162 sufficiently to cause ignition of fuel flowing past it.

The heating levels 142, 144 and 146 also create the smoke guiding updraft in the stack 44 by pre-heating the column 140 prior to incineration of the cars.

Choke and flame deflector 154, located rigidly in the center of the column 140 by adjustable choke supports 156, diffuses flame from the fuel injectors 148 to circular shape adjacent the heating stack wall 137 and provides limited stack 44 restriction for sufficient smoke column 140 heating. Locating bolts 158 on threaded ends 160 of the supports 156 provide fine adjustment of choke 154 location. The heating stack wall 137 is press-fitted into the open upper end of stack wall 135 and provides a heating surface for air coils 172 wrapped around its outer surface.

Air supply lines 112 are connected to adjustable 113 sources of compressed air (not shown) and the air coils 172 supplying air to the coils 172 for heating. The heated air is injected into the column 140 by air injector outlets 176 mounted at 90° intervals around the circumference of the final burn chamber stack wall 139. The wall 139 has an annular lip (not shown) on its lower open end connected to the annular lip 174 on the upper end of the heating wall 137 by any suitable means, such as connecting bolts (not shown). The air injector outlets 176 flex enabling fine adjustment of air injection direction. Generally, the outlet 176 ends are configured to direct injected air in a horizontal direction thereby creating a swirling effect within the final burn chamber portion of the column 140. The injected air provides a source of excess oxygen which combined with the fuel injector flame and superheated smoke in the vortex area 141 of the column 140, produces combustion resulting in extreme temperature and an intense flame. Heating the air insures maintenance of sufficient combustion temperature, and swirling the air insures complete combustion. Flame contact with the atmosphere at the upper end of the vortex area 141 supports a fringe flame. This results in an ideal combustion environment for removal of all combustibles which make up the pollutive and smoke components of the stack 44 discharge.

For greatest efficiency, stack flow resistance is reduced by injecting only the minimum amount of air necessary to sustain complete combustion of the smoke.

Figure 10:
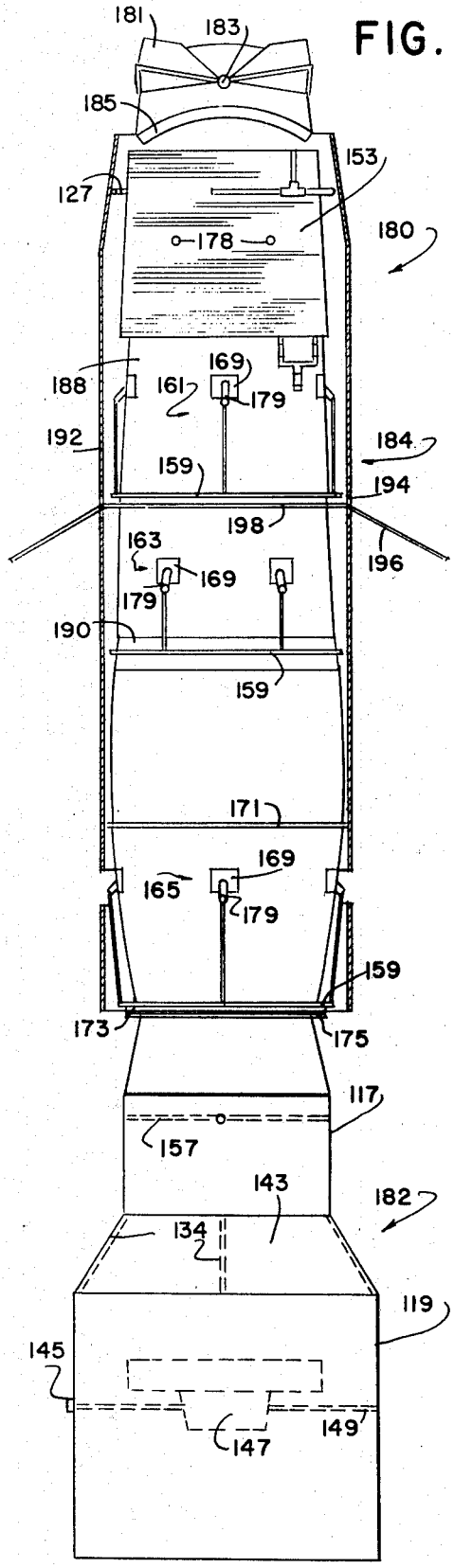
FIG. 10 is an elevational view, partly in section of a second smoke elimination stack embodying the principles of the present invention.

An alternative smoke elimination unit 180 embodying the principles of this invention is shown in FIG. 10. A smoke collecting chamber 182 and smoke elimination stack 184 are combined in a single unit 180.

The stack 184 comprises a lower cylindrical wall 186 and an upper cylindrical wall 188 connected by an annular securing ring and received in a stack sleeve 192 during operation. Openings 194 in the sleeve 192 allow stack securing guy wires 196 to be connected to an annular flange 198 on the upper wall 188. The sleeve 192 is secured to the lower wall 186 by a flange 171 and a lip 173. The lip 173 is also connected to a lip 175 on the smoke collecting chamber 182. An adjustable choke 181, choke pivot 183 and choke location control bar 185 are connected to the upper end of the upper wall 188 for controlling the size of the stack exist opening.

Three heating levels 161, 163 and 165 comprise spaced vertically adjacent rows of fuel injectors 179 radially mounted on the stack walls 186 and 188 by location plates 169. The injectors 179 are angled, offset and spaced in a manner similar to the injectors 148 in FIG. 9. Fuel is communicated from a fuel source (not shown) to the injectors 179 by fuel supply lines 159.

An adjustable choke (not shown) is located rigidly in the center of the stack column by choke supports (not shown). Locating bolts 178 attach the choke supports to the stack wall 188 and enable fine adjustments in choke location.

Air heating coils 153 are wrapped around the outer surface of the stack wall 188 adjacent the choke locating bolts 178. Air supplied to the coils 153 is heated by choke diffused flame from the fuel injectors 179. The heated air is injected into the stack column by air injector oulets 127 mounted radially around the circumference of the stack wall 188.

The smoke collecting chamber 182 comprises an upper chamber 117 and a lower chamber 119 connected by spaced wall pipes 134 covered by a skin 143. A draft control fan 147 is suspended in the lower chamber 119 by adjustable fan supports 149 and fan locating bolts 145. A throttle plate 157 is pivotably mounted in the upper chamber 117 to further control fan 147 generated draft.

It should be noted that the stacks 44 and 180 described with reference to the stationary incinerator embodiment 95 are also used in the mobile incinerator embodiments shown in FIGS. 1, 2, 3, 16 and 18.

While the invention has been described with reference to specific embodiments, the exact nature and scope of the invention is defined in the following claims.

What is claimed is:

1. Pollution control apparatus comprising a conduit having an inlet for receiving pollutants and an outlet for expelling relatively pollution free exhaust, body means positioned on the conduit forming a recirculation vortex combustion zone in the conduit immediately downstream of the body means, an annular space between said body means and said conduit providing communication between said combustion zone and said inlet, an air injection means in the conduit downstream of the body means for introducing air into the combustion zone, and heating means connected to the conduit upstream of the combustion zone for introducing heat into the conduit to heat pollutants, said pollutants being directed past said body means into said combustion zone and being burned in said combustion zone.

2. The apparatus of claim 1 wherein the heating means comprises flame injectors connected to the conduit for introducing flame into the conduit toward said body means, said body means being shaped to direct said flame through said space for burning pollutants in said combustion zone.

3. The apparatus of claim 2 wherein the body means comprises a tapered body oriented with an apex toward the inlet and a base toward the outlet.

4. The apparatus of claim 1 wherein the body means is a body having smaller lateral dimensions than the conduit, said body being positioned in the conduit to direct flame through the annular space between the body and the conduit.

5. The apparatus of claim 1 wherein the body means is located in a radially inwardly tapering portion of the conduit.

6. The apparatus of claim 1 wherein the body means is positioned in the conduit for restricting flow through the conduit, said heating means being connected to the conduit for introducing heat into the conduit upstream of the body means, said body means constraining said heat upstream of the body means for heating pollutants thereat.

7. The apparatus of claim 1 wherein the air injection means comprises air injectors arranged to introduce oxygen in a direction tangential to the flow path through the conduit.

8. The apparatus of claim 1 wherein the air introduced by the air injection means is pre-heated.

9. The apparatus of claim 1 wherein the heating means comprises a plurality of burners arranged circumferentially about the longitudinal axis of the conduit with the burner exits directed towards said body means.

10. The apparatus of claim 1 wherein the air injection means comprises a plurality of air injectors arranged circumferentially about the longitudinal axis of the conduit to introduce oxygen into the conduit adjacent the downstream edge of the body means in a direction tangential to the flow path through the conduit.

11. Pollution control apparatus comprising a conduit having an inlet for receiving pollutants and an outlet for expelling relatively pollution-free exhaust, body means positioned in the conduit forming a recirculation vortex combustion zone immediately downstream of the body means, heating means connected to the conduit for introducing heat into the conduit upstream of the body means for heating the body means and pollutants received in the conduit, and air injection means for introducing oxygen tangentially into the conduit adjacent the downstream edge of the body means to oxidize said heated pollutants, wherein the air injection means comprises tubing wrapped around the outer surface of the conduit, tubing inlet means connected to a source of pressurized oxygen for forcing oxygen through the tubing, heat being communicated from the conduit to oxygen in the tubing, and tubing outlet means for directing the heated oxygen into the conduit.

12. Pollution control apparatus comprising a conduit having an inlet for receiving pollutants and an outlet for expelling relatively pollution free exhaust, body means positioned in the conduit forming a recirculation vortex combustion zone in the conduit immediately downstream of the body means, space between said body means and said conduit providing communication between said combustion zone and said inlet, and heating means connected to the conduit for introducing heat into the conduit to heat pollutants, said pollutants being directed past said body means into said combustion zone and being burned in said combustion zone, wherein the heating means comprises plural arrays of heaters connected to the conduit at longitudinally spaced locations to form longitudinally spaced heating areas in the conduit.

13. Pollution control apparatus comprising a conduit having an inlet for receiving pollutants and an outlet for expelling relatively pollution free exhaust, body means positioned in the conduit forming a recirculation vortex combustion zone in the conduit immediately downstream of the body means, space between said body means and said conduit providing communication between said combustion zone and said inlet, and heating means connected to the conduit for introducing heat into the conduit to heat pollutants, said pollutants being directed past said body means into said combustion zone and being burned in said combustion zone, wherein the heating means comprises a plurality of burners arranged circumferentially about the longitudinal axis of the conduit with the burner exits directed towards said body means, wherein the burners are angled toward the outlet.

14. The apparatus of claim 13 wherein the burners are angled toward the body means and the conduit outlet at about a 45° angle.

15. A method for oxidizing pollutants comprising directing the pollutants into a conduit, heating pollutants in the conduit, upstream of a combustion zone, directing said pollutants through an annular space between the conduit and a body positioned in the conduit, heating the pollutants and the body, injecting oxygen tangentially into the conduit downstream of the body immediately adjacent the recirculation vortex combustion zone generated downstream of the body, and mixing the oxygen with the heated pollutants and the recirculated hot combustion products in the vortex combustion zone to oxidize said pollutants.

16. The method of claim 15 wherein the heating step comprises injecting heat into the conduit, and constraining said heat to an area upstream of the downstream edge of the body.

17. The method of claim 15 wherein the heating step comprises injecting flame into the conduit upstream of the downstream edge of the body, and deflecting said flame from the body to a location adjacent walls of the conduit.

* * * * *